US007843138B2

(12) United States Patent
Geissler et al.

(10) Patent No.: US 7,843,138 B2
(45) Date of Patent: Nov. 30, 2010

(54) POWER SUPPLY FOR A HOT-FILAMENT CATHODE

(75) Inventors: Steven J. Geissler, Ft. Collins, CO (US); James R. Kahn, Ft. Collins, CO (US); Harold R. Kaufman, Laporte, CO (US)

(73) Assignee: Kaufman & Robinson, Inc., Ft. Collins, CO (US)

( * ) Notice: Subject to any disclaimer, the term of this patent is extended or adjusted under 35 U.S.C. 154(b) by 414 days.

(21) Appl. No.: 12/157,586

(22) Filed: Jun. 11, 2008

(65) Prior Publication Data

US 2009/0309509 A1 Dec. 17, 2009

(51) Int. Cl.
*H05B 39/00* (2006.01)

(52) U.S. Cl. ..... 315/105; 315/49; 315/276; 315/279

(58) Field of Classification Search ..... 315/49, 315/94, 105, 115, 209 R, 226, 246, 276, 279
See application file for complete search history.

(56) References Cited

U.S. PATENT DOCUMENTS 4,508,996 A * 4/1985 Clegg et al. ..... 315/224
4,630,005 A * 12/1986 Clegg et al. ..... 331/113 A
4,651,058 A 3/1987 Hamada et al.
4,816,724 A 3/1989 Hamada et al.
RE33,057 E * 9/1989 Clegg et al. ..... 315/224
4,912,375 A 3/1990 Deglon et al.
5,187,413 A 2/1993 Araki et al.
5,541,827 A 7/1996 Allfather
5,565,743 A 10/1996 Yamashita et al.
5,991,169 A 11/1999 Kooken
6,304,475 B1 10/2001 Iwata et al.
6,911,789 B2 6/2005 Geissler et al.

OTHER PUBLICATIONS

Operation of Broad-Beam Sources, Kaufman, Robinson,Commonwealth Scientific Corporation, Chapter 3, pp. 23-32 (1984) Catalog ST-5, Signal Transformer Company, Inwood, NY.
Spangenberg, Vacuum Tubes, Chapter 4—Electronic Emission, p. 23-57 (1948).
Kaufman et al., Characteristics, Capabilities, and Applications of Broad-Beam Sources, 1987.
Olson, IOn Milling Induced ESD DAmage During MR Head Fabrication, EOS/ESD Symposium 98-332 (1998).
Kaufman et al., Ion Source Design For Industrial Applications, AIAA Journal, vol. 20, No. 6, p. 745-760 (1982).
Zhurin et al.,Physics of closed drift thrusters, Plasma Sources Sci. Technol. 8, pp. R1-R20 (1999).

* cited by examiner

*Primary Examiner*—Thuy Vinh Tran
(74) *Attorney, Agent, or Firm*—Dean P. Edmundson

(57) ABSTRACT

In accordance with one embodiment of the present invention, there is provided a switch-mode power supply to generate the heating current for a hot-filament electron-emitting cathode. The power supply directly couples, without an output power transformer, the output from a full-bridge converter that operates at an output frequency in the range from ten Hz to tens of Khz to the output terminals of the power supply. A connection to a reference potential that minimizes the potential fluctuation of the cathode is provided by the center tap on an autotransformer connected across the output terminals, where the conductors in the autotransformer are sized for half of the emission current from the cathode rather than the much larger heating current.

8 Claims, 8 Drawing Sheets

POWER SUPPLY FOR A HOT-FILAMENT CATHODE

FIELD OF INVENTION

This invention relates generally to ion and plasma sources, and more particularly it pertains to the power supplies that generate heating currents for the electron-emitting, hot-filament cathodes incorporated in such sources.

BACKGROUND ART

Applications for industrial ion and plasma sources include etching, deposition and property modification, as described by Kaufman, et al., in the brochure entitled *Characteristics, Capabilities, and Applications of Broad-Beam Sources*, Commonwealth Scientific Corporation, Alexandria, Va. (1987).

Both gridded and gridless ion sources are used in these industrial applications. Gridded ion sources are described in an article by Kaufman, et al., in the *AIAA Journal*, Vol. 20 (1982), beginning on page 745. The end-Hall ion source is one type of gridless ion source and is described in U.S. Pat. No. 4,862,032—Kaufman, et al., while the closed-drift ion source is another type of gridless ion source and is described by Zhurin, et al., in an article in *Plasma Sources Science & Technology*, Vol. 8, beginning on page R1. These publications are incorporated herein by reference.

Both gridded and gridless ion sources incorporate electron-emitting hot-filament cathodes. These cathodes function as cathode-neutralizers in gridless ion sources and as both discharge-chamber cathodes and neutralizers in gridded ion sources. Power supplies provide heating currents for these cathodes, where the heating current increases the cathode temperature sufficiently for the thermionic emission of electrons. Some of the materials, operating conditions, common problems, and lifetime limitations of electron-emitting hot-filament cathodes are described by Kaufman, et al., in Chapter 3 of the book, *Operation of Broad-Beam Sources*, Commonwealth Scientific Corporation, Alexandria, Va. (1984).

The design techniques for these power supplies employ a conversion frequency to convert from line voltage and current to output voltage and current. This conversion frequency is either 50-60 Hz or a considerably higher frequency, typically ≧25 Khz. The 50-60 Hz techniques are called "linear/line-frequency-phase-control" (or "linear/LFPC") herein. The techniques in which a conversion frequency independent of line frequency is generated and digital on-off states are used for the power switching devices are called "switch-mode." Examples of switch-mode techniques are given by Pressman in the book, *Switching Power Supply Design*, McGraw-Hill, Inc., New York (1991).

Power supplies based on linear/LFPC have been readily available for many years, but are large and heavy, due mostly to the large, heavy 50-60 Hz transformers that are incorporated. Power supplies based on switch-mode techniques have been readily available for the last two decades and are characterized by smaller sizes and lighter weights, due to the much smaller and lighter transformers that can be used at the higher frequencies.

The heating current generated by the power supplies is of two types: direct current (dc) and alternating current (ac) Either linear/LFPC or switch-mode power supplies can be used to generate a dc heating current for a hot-filament cathode. With either type of power supply, however, the cathode lifetime is substantially reduced due to the dc nature of the current.

Either linear/LFPC or switch-mode power supplies can also be used to generate an ac heating current. In either case the power output from a well-designed supply is usually from an output transformer operating at the conversion frequency that is used, i.e., either 50-60 Hz or ≧25 Khz. While the use of a 50-60 Hz output frequency presents no problems, the reactive impedances in the transmission line between the power supply and the cathode are significant at the ≧25 Khz frequency. These reactive impedances cause impedance matching problems. An important exception to the use of an output transformer is described in U.S. Pat. No. 6,911,789—Geissler, et al, which is incorporated herein by reference.

The use of an output transformer permits the connection to a reference potential to be made through a center tap in the transformer secondary to both minimize plasma disturbances and increase filament lifetime. In the discharge chamber of a gridded ion source, the reference potential is the negative terminal of the discharge supply. In the neutralizer of a gridded ion source or the cathode-neutralizer of a gridless ion source, the reference potential is usually ground. If a discharge is used to generate a plasma that fills a vacuum chamber, the reference potential would usually be the potential of the vacuum chamber.

To summarize the technology, linear/LFPC power supplies that generate 50-60 Hz heating currents are widely used, but are large and heavy due to the transformers used in them. Switch-mode power supplies that generate ac heating currents at a ≧25 Khz conversion frequency are much smaller and lighter, but are limited by impedance and impedance-matching effects of the transmission line between the power supply and the hot-filament cathode.

SUMMARY OF INVENTION

In light of the foregoing, it is an object of the present invention to provide a power supply for a hot-filament, electron-emitting cathode that is small and light, but does not have significant transmission-line impedance problems.

Another object of the present invention is to use switch-mode techniques to generate a heating current for such a cathode without the reduced lifetime of using direct current.

Yet another object of the present invention is to use switch-mode techniques to generate an ac heating current for such a cathode at an output frequency independent of the conversion frequency.

Still another object of the present invention is to provide a switch-mode power supply for such a cathode that can generate a heating current at an output frequency high enough so that the period for a cycle is short compared to the thermal time constant of the hot-filament cathode.

A further object of the present invention is to provide a switch-mode power supply for such a cathode that can generate a heating current at an output frequency low enough so that the transmission-line impedance matching problems are substantially reduced.

A yet further object of the invention is to use switch-mode techniques to generate a heating current for such a cathode without using a heavy, expensive output transformer.

A still further object of the invention is to provide a power supply for such a cathode that is simple, economical, and reliable, but provides the electrical potential equivalent of a center tap on an output power transformer for making a connection to a reference potential (frequently ground).

In accordance with one embodiment of the present invention, there is provided a switch-mode power supply to generate the heating current for a hot-filament electron-emitting cathode. The power supply directly couples, without an output power transformer, the output from a full-bridge converter that operates at an output frequency in the range from ten Hz to tens of Khz. A connection to a reference potential that minimizes the potential fluctuation of the cathode is provided by an autotransformer, where the conductors in the autotransformer are sized for the emission current from the cathode rather than the much larger heating current.

DESCRIPTION OF FIGURES

Features of the present invention which are believed to be patentable are set forth with particularity in the appended claims. The organization and manner of operation of the invention, together with further objectives and advantages thereof, may be understood by reference to the following descriptions of specific embodiments thereof taken in connection with the accompanying drawings, in the several figures of which like reference numerals identify like elements and in which:

DESCRIPTION OF PRIOR ART

Figure 1:
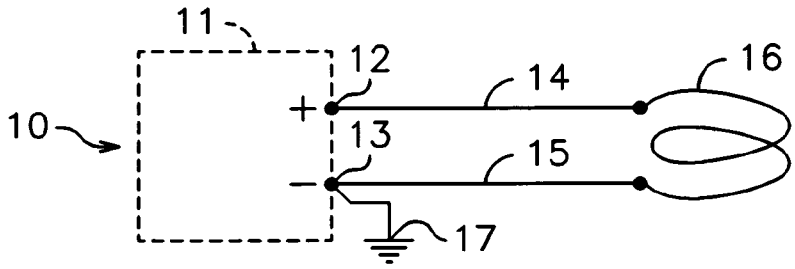
Fig. 1 (PRIOR ART)
FIG. 1 is a simplified electrical circuit diagram of a hot-filament, electron-emitting cathode together with a prior-art direct-current power supply to generate the heating current for the cathode.

Referring to FIG. 1, there is shown prior-art power supply 10 within enclosure 11 for generating a direct (dc) heating current to positive power output terminal 12 and negative power output terminal 13. As is well known to those skilled in the art, power supply 10 can use either linear/LFPC (50-60 Hz) or switch-mode (approximately ≧25 Khz) techniques. Rack-mount power supplies using both techniques have been manufactured by Lambda EMI, Neptune, N.J. Their TCR Series use linear/LFPC techniques, while their EMS Series uses switch-mode techniques. Comparing similar power ratings in the 1-2 Kw range, the switch-mode power supplies are about half the height of the linear/LFPC supplies and weigh about one-third as much. The switch-mode power supplies thus have substantial size and weight advantages over the linear/LFPC designs.

Terminals 12 and 13 of power supply 10 are connected to transmission-line conductors 14 and 15, which in turn are connected to electron-emitting hot-filament cathode 16. Power supply 10 is a source of voltage and current sufficient to heat cathode 16 to the temperature necessary for thermionic electron emission. Terminal 13 is also connected to a reference potential, in this case ground 17. Inasmuch as the circuit is a dc one, the resistances of transmission-line conductors 14 and 15 are the important transmission-line parameters. For efficient operation, these resistances should be small compared to the operating resistance of cathode 16. In plasma and ion-beam apparatus, the ground is usually the potential of the surrounding vacuum chamber which in turn is usually, but not always, at earth ground. The connection of the reference potential could have been made to terminal 12 instead. Also, as described in the Background Art section, the reference potential could also be the negative terminal of the discharge supply in a gridded ion source.

Figure 1A:
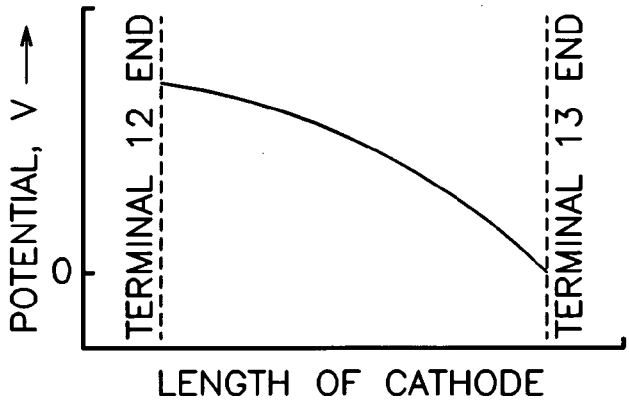
Fig. 1a (PRIOR ART)
FIG. 1*a* shows the potential distribution along the hot-filament cathode of FIG. 1.

Referring to FIG. 1*a*, there is shown the potential distribution along hot-filament cathode 16 of FIG. 1, where the potential distribution results from the electrical resistance of the cathode and the distribution of heating current therein. As would be expected, the cathode is at a more positive potential at the end closest to positive terminal 12. With ground defined as zero potential, the cathode end closest to terminal 13 is at approximately zero potential. Hot-filament cathodes are almost always fabricated from a refractory-metal wire (typically tantalum or tungsten) with a uniform circular cross section. To do otherwise would be both inconvenient and expensive. With a uniform cross section, one might expect the potential to be distributed uniformly along the cathode. The potential distribution shown in FIG. 1*a* is not uniform over the length of the cathode, but drops more rapidly near the end closest to negative terminal 13. To explain this non-uniform distribution, it is helpful to consider the currents to and from cathode 16.

Figure 1B:
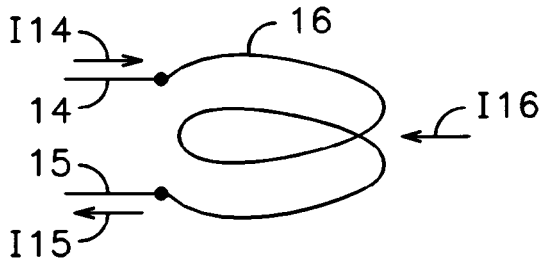
Fig. 1b (PRIOR ART)
FIG. 1*b* is a simplified electrical circuit diagram of the hot-filament cathode of FIG. 1 together with its connecting transmission-line conductors, showing conventional currents and their directions.

Referring to FIG. 1*b*, there is shown hot-filament cathode 16 of FIG. 1 and portions of connecting conductors 14 and 15, together with the directions of conventional (positive) currents to this cathode. Current I14 is the current to cathode 16 in transmission-line conductor 14 and current I15 is the current from that cathode in transmission-line conductor 15. Note that the conventional current representation results in the electron emission from cathode 16 becoming conventional current I16 to that cathode. From conservation of current to the cathode, $$I14-I15+I16=0. \quad (1)$$

Because I14, I15, and I16 are all positive quantities with directions as defined in FIG. 1*b* and used in Equation (1), $$I15>I14. \quad (2)$$

To give a specific example of this imbalance, the EH1000, a commercial end-Hall ion source manufactured and sold by Kaufman & Robinson, Inc., has a tungsten cathode-neutralizer that is 0.51 mm in diameter with an overall length of about 15 cm. The heating current, approximately an average of I14 and I15, is in the range of 12-20 A, being near the high value at the beginning of life and near the low value at end of life. A typical electron emission, I16, is 5 A. The emission is thus 25-40 percent of the mean heating current. For a dc heating current, this means that the end of hot-filament cathode 16 shown in FIG. 1 that is closest to terminal 13 becomes much hotter than the other, with most of the emission as well as most of the sublimation and chemically assisted erosion occurring near that end.

The degree to which the concentration of emission takes place may not be readily apparent to one unskilled in the art. The emission equation includes an exponential term, which Spangenberg in Chapter 4 of the book, *Vacuum Tubes*, McGraw-Hill Book Company, New York (1948), says "causes the emission-temperature function to be one of the most rapidly varying functions found in nature." From Figure 4.10 in the aforementioned chapter, it is shown that a drop of 25 percent in heating current for a given diameter of tungsten wire results in a more than 95 percent drop in emission. From a theoretical viewpoint, it should be clear that an emission current which is 25-40 percent of the mean dc heating current will have a major effect on cathode operation. Experimentally, the cathode lifetime with a dc heating current is about half that with a balanced or symmetrical ac heating current, which will be described in connection with the circuit of FIG. 2.

One obvious solution to the current imbalance of relation (2) is to use much larger heating currents, so that the emission is a smaller fraction of the heating current. The transmission-line conductors are comprised of the cable between the power supply 10, the electrical feedthroughs in the vacuum-chamber wall, and the cables inside the vacuum chamber. The typical cable length from a cathode power supply 10 to a vacuum chamber is 6 meters, while the typical cable length internal to the vacuum system is 40 cm. Increasing the current capacity of these cables results in a variety of weight, safety, power, ease of handling, and hardware problems. In addition, high-current electrical feedthroughs are expensive and take up more space than feedthroughs designed for lower currents. Increasing the heating current is thus neither inexpensive or convenient.

Note that the current imbalance in the circuit shown in FIG. 1 does not depend on the reference potential connection to terminal 13. The potential of the cathode would extend below zero if the reference potential were connected to terminal 12, instead of terminal 13, but the same current imbalance and cathode lifetime limitation would exist.

Another solution, perhaps less obvious, is to alternate the emission and current functions, so that the two functions do not occur at the same time, in the manner used for the electron sources incorporated in flat displays (see U.S. Pat. No. 4,651,058—Hamada, et al., or U.S. Pat. No. 4,816,724—Hamada, et al.). Depending on the exact implementation, such an approach could greatly reduce or eliminate the potential variation along the hot-filament cathode during emission, hence reduce or eliminate the nonuniform erosion of the cathode. For heating currents of the order of 20 A and heating powers of several hundred watts, however, such a power-supply apparatus would be neither simple nor economical.

Figure 2:
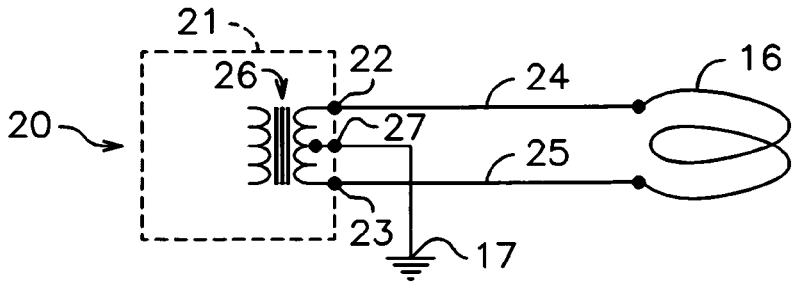
Fig. 2 (PRIOR ART)
FIG. 2 is a simplified electrical circuit diagram of a hot-filament, electron-emitting cathode together with a prior-art alternating-current power supply to generate the heating current for the cathode, where the power supply uses an output power transformer with a center tap.

Referring to FIG. 2, there is shown prior-art alternating-current (ac) power supply 20 within enclosure 21 for generating an alternating heating current to power output terminals 22 and 23. Terminals 22 and 23 of power supply 20 are connected to transmission-line conductors 24 and 25, which in turn are connected to electron-emitting hot-filament cathode 16. Within power supply 20 there is output power transformer 26, the secondary of which is connected to output terminals 22 and 23. The center tap of the secondary is connected to output terminal 27 which, in turn, is connected to a reference potential, in this case ground 17. As discussed in connection with FIG. 1, other reference potentials could have been used. Inasmuch as the circuit in FIG. 2 is an ac one, both the resistances and reactive impedances of transmission-line conductors 24 and 25 can be important. In general, the most serious transmission-line design and operating problems result from the reactive impedances at the higher ac frequencies, approximately ≧25 Khz.

Figure 2A:
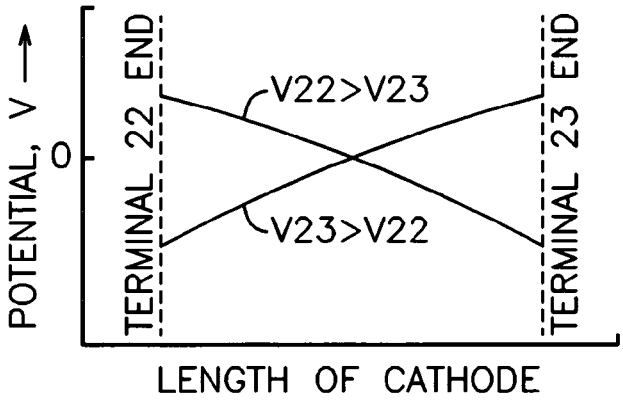
Fig. 2a (PRIOR ART)
FIG. 2*a* shows the potential distributions along the hot-filament cathode of FIG. 2.

Referring to FIG. 2*a*, there are shown the potential distributions along hot-filament cathode 16 of FIG. 2, where the potential distributions result from the electrical resistance of the cathode and the distribution of heating currents therein. Because an ac heating current is used for the cathode, two curves are shown for the peak heating currents in the two directions. One is for the case where the cathode potential nearest terminal 22, V22, is greater than the cathode potential nearest terminal 23, V23 (V22>V23), while the other is for the case where the cathode potential nearest terminal 23 is greater than the cathode potential nearest terminal 22 (V23>V22). With the curves drawn for the maximum currents in the two directions, the potential distributions represent the potential extrema. If the waveform is other than a square wave, there are potential distributions intermediate of the two extrema. While the potential variations with cathode length in FIG. 2*a* are closer to linear than the variation shown in FIG. 1*a*, they are still not linear. The cathode is at a more uniform temperature along its length with an ac heating current. But the variation in potential with length is always greater at the end carrying the greater current—that is, the more negative end, which carries the sum of both heating and emission currents.

Figure 2B:
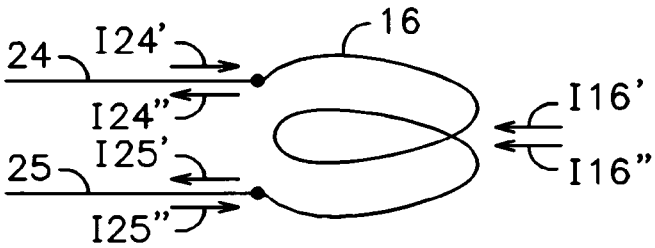
Fig. 2b (PRIOR ART)
FIG. 2*b* is a simplified electrical circuit diagram of the hot-filament cathode of FIG. 2 together with its connecting transmission-line conductors, showing conventional currents and their directions.

Referring to FIG. 2*b*, hot-filament cathode 16 of FIG. 2 is shown there together with the currents to this cathode. These currents are defined in a manner similar to those in FIG. 1*b*, except that primed quantities denote currents for the case where conductor 24 (and terminal 22) is positive relative to conductor 25 (and terminal 23), and double-primed quantities denote currents for the case where conductor 25 (and terminal 23) is positive relative to conductor 24 (and terminal 22). The first case is described mathematically as V22>V23, while the second is described as V23>V22. The directions of the currents again correspond to conventional (positive) currents. For the primed case, the current balance from conservation of current is similar to the dc case and $$I24'-I25'+I16'=0, \quad (3)$$

$$I25'>I24'. \quad (4)$$

For the double primed case, the currents are such that $$I25''-I24''+I16''=0, \quad (5)$$

$$I24''>I25''. \quad (6)$$

The two curves shown in FIG. 2*a* were drawn with the assumption that the potential waveform from power supply 20 is symmetrical for the two half-cycles of heating current. That is, except for sign, the shape and amplitude of the waveform is the same. Although nonsymmetrical waveforms have been used in ac power supplies, symmetrical ones are more common. With this assumption and the center tap of transformer 26 connected to terminal 27, which in turn is connected to the reference potential, the potential distributions along cathode 16 are also symmetrical for the two half-cycles of the heating current. The only potential fluctuations are the ends of cathode 16 oscillating about a constant mean value of zero.

For the symmetrical potential distributions in the primed and double primed cases in FIG. 2*a*, the heating of the cathode is also symmetrical and it follows that $$I16'=I16''. \quad (7)$$

$$I25'-I24'=I24''-I25''. \quad (8)$$

The balanced or symmetrical current distributions of Equations (7) and (8) constitute the preferred prior-art approach for heating hot-filament cathodes, and offers a substantial cathode-lifetime advantage over the dc distribution of Equations (1) and (2).

While the above description of currents and cathode heating assumes complete symmetry for the current flow in the two directions, it should be apparent that moderate departures from symmetry will result in moderate lifetime penalties. Departures from symmetrical heating of 10, 20, or even 30 percent would still permit most of the increased-lifetime benefits of using an ac heating current. Such departures could, for example, result from the non-symmetrical firing of poorly matched silicon controlled rectifiers.

It should be pointed out that, for any of the ac frequencies mentioned (50-60 Hz to over 25 Khz), the thermal time-constant of a typical hot-filament cathode is much greater than the period of the ac current. The temperature of the hot-filament cathode is therefore primarily a function of the time-averaged heating, not the instantaneous heating.

Either linear/LFPC or switch-mode techniques can be used for power supply 20 shown in FIG. 2. When linear/LFPC techniques are used, the output also operates at the 50-60 Hz conversion frequency. Although there are reactive impedances in transmission-line conductors 24 and 25, these impedances are small at 50-60 Hz compared to the resistive impedances in these conductors and cathode 16, and there are no significant impedance-matching problems with the cable lengths described in connection with FIG. 1, or even longer cable lengths. The major shortcomings of linear/LFPC techniques are the size and weight of the output power transformers used. Commercial versions of power supply 20 are generally not available because such supplies are integrated into overall power-supply units for ion sources. However, the size and weight advantages of switch-mode ac supplies should be approximately the same as described for dc supplies in connection with FIG. 1.

When switch-mode techniques are used, the output of power supply 20 is at a conversion frequency approximately 25 Khz. This frequency results from: (1) the need to have a substantially higher frequency than 50-60 Hz to obtain size and weight advantages over linear/LFPC techniques, (2) the need to exceed the audio range which for some people extends to over 20 Khz, and (3) because the transmission-line impedance-matching problems generally increase with frequency, hot-filament power supplies are usually operated at frequencies near the low end of the switch-mode range, i.e., near 25 Khz. Even at this relatively low frequency for switch-mode techniques, longer than usual cable lengths can present serious impedance-matching problems.

In summary, the prior-art circuit of FIG. 2 has been the most widely used approach for heating electron-emissive hot-filament cathodes because it provides the longest lifetime for a hot-filament cathode and acceptable levels of plasma disturbance with ac cathode potentials that oscillate about a mean value. When linear/LFPC techniques are used, the transmission-line problems are minimal, but the power-supply size and weight are large. When switch-mode techniques are used, the power-supply size and weight are much smaller, but the transmission-line problems can be substantial.

Figure 3:
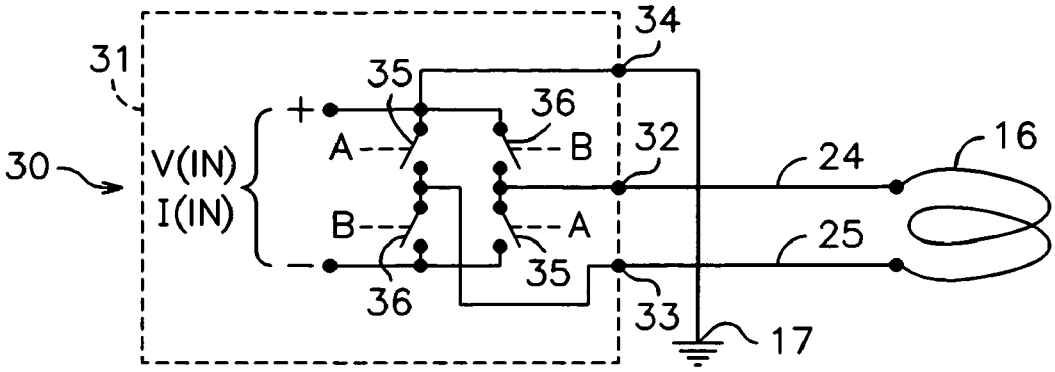
Fig. 3 (PRIOR ART)
FIG. 3 is a simplified electrical circuit diagram of a hot-filament, electron-emitting cathode together with another prior-art alternating-current power supply to generate the heating current for the cathode, where the power supply uses switching means without reference to whether the switching means is mechanical, solid state, or gaseous in nature.

Referring to FIG. 3, there is shown another prior-art alternating-current (ac) power supply, which is described further in the aforementioned U.S. Pat. No. 6,911,789—Geissler, et al. Power supply 30 is within enclosure 31 and generates an alternating heating current to power output terminals 32 and 33. These output terminals are connected to transmission-line conductors 24 and 25, which in turn are connected to electron-emitting hot-filament cathode 16. There is also reference output terminal 34 to connect to the reference potential, in this case ground 17. Inasmuch as FIG. 3 shows an ac circuit, it is possible for both the resistances and reactive impedances of transmission-line conductors 24 and 25 to be significant.

Within power supply 30 there are positive terminal + and negative terminal −. Electrical power is supplied to the positive and negative terminals at potential difference V(IN) and electrical current I(in). The positive terminal is also connected internally to output terminal 34. Electrical power is supplied to the positive and negative terminals by means well understood by those skilled in the art, for example by using a commercially available switch-mode dc power supply. A linear/LFPC dc supply could also be used, but such a choice would have the disadvantage of an undesirably large and heavy transformer or transformers due to the low conversion frequency.

Within power supply 30, and also connected to the positive and negative terminals, there is a full-bridge converter comprised of two switching means 35 and two more switching means 36, without reference to whether switching means 35 and 36 are mechanical, solid state, or gaseous in nature. The conduction of switching devices 35 is controlled by signal A, while the conduction of switching devices 36 is controlled by signal B. That is, signals A and B selectively and controllably change switches 35 and 36 between conducting and nonconducting states. By alternating control signals A and B, terminals 32 and 33, and therefore conductors 24 and 25, are alternatively connected to potential difference V(IN) with one polarity and then the opposite polarity.

Figure 3A:
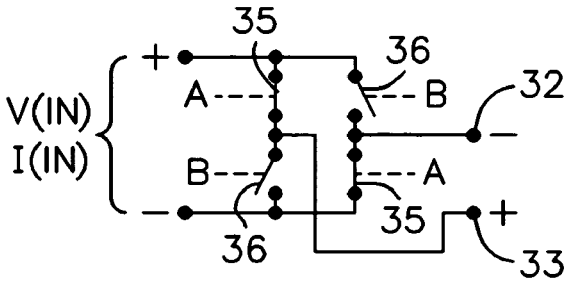
Fig. 3a (PRIOR ART)
FIG. 3*a* shows conductivity of the switching means of FIG. 3 for the case where terminal 33 is positive relative to terminal 32.
Figure 3B:
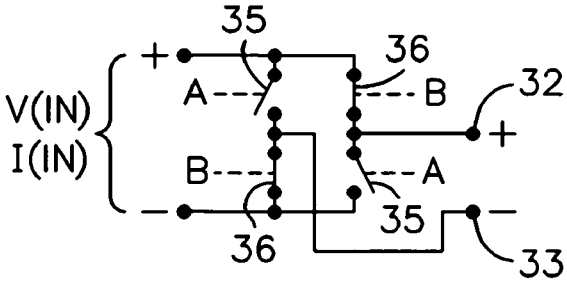
Fig. 3b (PRIOR ART)
FIG. 3*b* shows the conductivity of the switching means of FIG. 3 for the case where terminal 32 is positive relative to terminal 33.

This alternative connection of terminals to opposite polarities can be seen more clearly by referring to FIGS. 3*a* and 3*b*. Referring first to FIG. 3*a*, there is shown the full-bridge converter of FIG. 3 with switching means 35 in conducting states and switching means 36 in nonconducting states, resulting in terminal 32 being connected to the negative potential and terminal 33 being connected to the positive potential. Referring next to FIG. 3*b*, there is shown the full-bridge converter of FIG. 3 with switching means 35 in nonconducting states and switching means 36 in conducting states, resulting in terminal 32 being connected to the positive potential and terminal 33 being connected to the negative potential.

The control signals A and B are preferably electrical but may also be magnetic or mechanical in nature. Regardless of the nature of these signals, they originate from a pulse or frequency generator using techniques well known to those skilled in the art. For example, the generator may be a simple RC oscillator, or it may be one of a number of other signal generators that can be fabricated or purchased. The output may be controlled by varying the frequency and/or duration of signals A and B. Alternatively, the output may be varied by varying voltage, V(IN), and/or current, I(IN) of the dc input.

Although intended as general switching means, switching means 35 and 36 are indicated by the schematic representations in FIG. 3 as mechanically activated switches. As such, relays could be used at some of the output switching frequencies of interest, with vacuum relays more likely to give the desired lifetime. Although the immediate actuation of the switches in relays is mechanical, the mechanical motion originates from electrical signals.

Figure 3C:
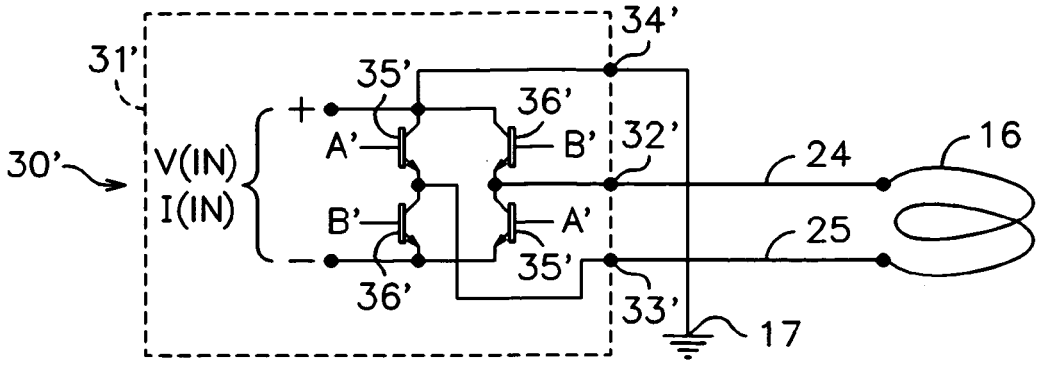
Fig. 3c (PRIOR ART)
FIG. 3*c* shows a variation of a prior-art circuit diagram that differs from that shown in FIG. 3 in that solid-state switching devices are used.

Referring to FIG. 3*c*, there is shown a more specific embodiment of the prior art shown in FIG. 3, in which the switches are of solid-state construction. The numbers of the components of power supply 30' in FIG. 3*c* are identical with those of power supply 30 in FIG. 3, except for the use of primes to denote the more specific embodiment of switching means in FIG. 3*c*. Control signals A' and B' to control solid-state switching devices 35' and 36' are electrical, and could come directly from a pulse or frequency generator.

Figure 3D:
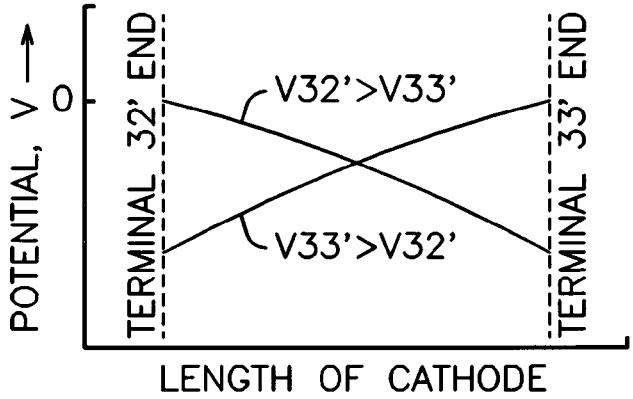
Fig. 3d (PRIOR ART)
FIG. 3*d* shows the potential distributions along the hot-filament cathode of FIG. 3.

Referring to FIG. 3*d*, there are shown the potential distributions along hot-filament cathode 16 obtained using the circuit of FIG. 3*c*, where the potential distributions again result from the electrical resistance of the cathode and the distribution of heating currents therein. To be more specific, the impedance of a hot-filament cathode is essentially resistive, so that a particular potential distribution has a corresponding current distribution. Because an ac heating current is used for the cathode, two curves are again shown for the peak heating currents in the two directions. One is for the case where the cathode potential nearest to terminal 32', V32', is greater than the cathode potential nearest terminal 33', V33' (V32'>V33'), while the other is for the case where the cathode potential nearest terminal 33' is greater than the cathode potential nearest terminal 32' (V33'>V32'). The two curves shown in FIG. 3*d* were again drawn with the assumption that the waveform from power supply 30' is symmetrical for the two half-cycles of heating current. That is, that, except for sign, the shape and amplitude of the current waveform is the same.

The currents to cathode 16 are defined in a manner similar to those shown in FIG. 2*b*, except that primed quantities in FIG. 2*b* denote currents for the case where terminal 32' is positive relative to terminal 33' V32'>V33'), and double primed quantities in FIG. 2*b* denote currents for the case where terminal 33' is positive relative to terminal 32 (V33'>V32'). With these definitions and the assumption of a symmetrical waveform of heating current, the heating of the cathode is also symmetrical as described by equations (7) and (8).

The cathode power supply of either FIG. 3 or FIG. 3*c* has the same advantage of long cathode lifetime as the power supply of FIG. 2. An important difference between the circuit of FIG. 2 and that of either FIG. 3 or FIG. 3*c*, however, is that the circuit of either FIG. 3 or FIG. 3*c* doesn't require an output transformer because it doesn't require a center tap to connect to the reference potential. The ac potential waveform can therefore be generated using switch-mode techniques but, at the same time, the frequency of the cathode heating current (output frequency) can be much lower than the conversion frequency, thereby avoiding most of the transmission-line impedance-matching problems normally encountered with switch-mode techniques.

The prior art of FIGS. 3, 3*a*, 3*b*, and 3*c* is described further in the aforementioned U.S. Pat. No. 6,911,789—Geissler, et al. As described therein, the preferred frequency range for the ac heating current is from about ten Hz to ten kHz, which at the low end is more rapid than the thermal time constant of most hot filaments and at the high end is low enough to keep the reactive impedance of the transmission-line conductors 24 and 25 to a moderate level.

As discussed in connection with the prior-art power supply of FIG. 2, complete symmetry of the waveform in the two directions of current flow is not required. Departures from symmetrical heating of 10, 20, or even 30 percent would still permit most of the increased-lifetime benefits of using an ac heating current.

Figure 3E:
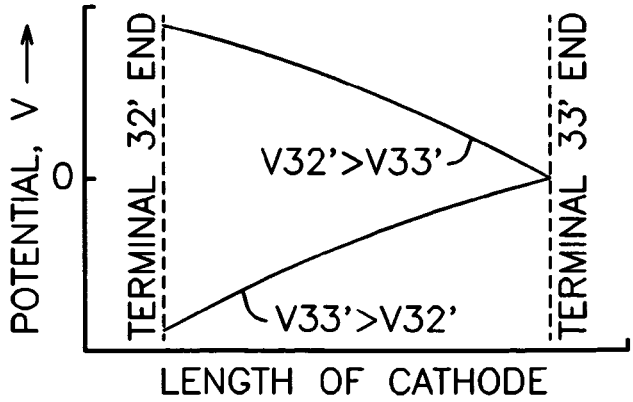
Fig. 3e (PRIOR ART)
FIG. 3*e* shows the potential distributions that would occur along the hot-filament cathode of FIG. 3 if the reference potential (ground) were connected to terminal 33 instead of terminal 34.

The reference potential in FIG. 3*c* is connected to the positive potential terminal within power supply 30', which is why the potential distributions in FIG. 3*d* extend downward from zero. If the reference potential had been connected to the negative terminal, the potential distributions would have extended upward from zero. If ground had been connected instead to output terminal 33', then the potential distributions along the cathode would be as shown in FIG. 3*e*, with the curve for V32'>V33' extending upward from zero and the curve for V33'>V32' extending downward, resulting in an even larger distribution in potential relative to the reference potential.

The most significant performance feature of the prior art of FIGS. 3, 3*a*, 3*b*, and 3*c* is the lack of filament-potential symmetry about the reference potential. The filament potential can extend downward from the reference potential by the magnitude of the applied potential difference, or upward from it, but it cannot be approximately symmetrical about the reference potential as shown in FIG. 2*a* for the prior-art power supply shown in FIG. 2. This means that the maximum departure in filament potential from the reference potential is about twice as large for the prior art of FIG. 3 as it is for the prior art of FIG. 2.

For specific examples of the maximum departures from the reference potential, the EH1000 cathode can again be used. The approximate potential drop across this cathode at operating conditions is about 25 Vrms. For the prior art of FIG. 3*c*, the maximum departure from the reference potential (FIG. 3*d*) is about −25 V if a square-wave waveform is assumed and about −35 V if a sine wave is assumed. In comparison, the prior art of FIG. 2 would have maximum departures of only about half these values. Depending on the particular application, these differences can be important. Trying to generate a quiescent ion beam using a hot-filament neutralizer is one example where small departures from the reference potential can be important. The sensitivity of some workpieces to charging problems is described in an article by Olson in the *EOS/ESD Symposium,* 98-332 (1998).

Figure 4:
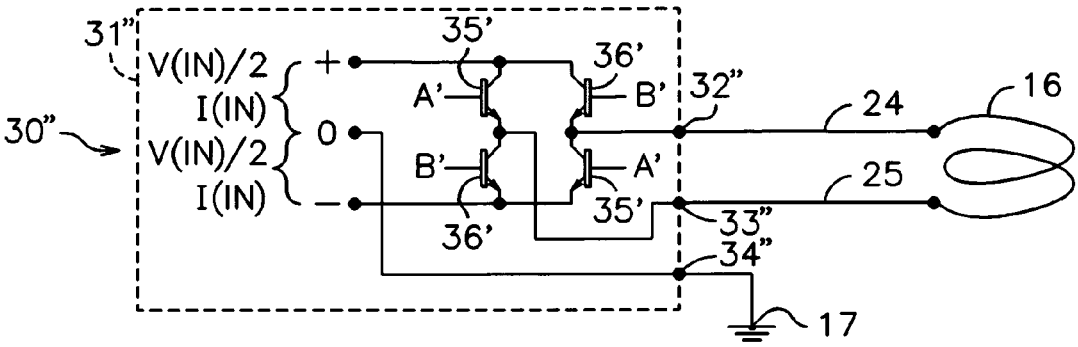
Fig. 4 (PRIOR ART)
FIG. 4 is a simplified electrical circuit diagram of a hot-filament, electron-emitting cathode together with yet another prior-art alternating-current power supply to generate the heating current for the cathode, where the power supply uses solid-state switching means.

Referring to FIG. 4, there is shown yet another prior-art alternating-current (ac) power supply 30" within enclosure 31" for generating an alternating heating current to output terminals 32" and 33". These output terminals are connected to transmission-line conductors 24 and 25, which in turn are connected to electron-emitting hot-filament cathode 16. There is also output terminal 34" to connect to the reference potential, in this case ground 17. Inasmuch as FIG. 4 uses ac heating current, it is again possible for both the resistances and reactive impedances of transmission-line conductors 24 and 25 to be significant.

Power supply 30" in FIG. 4 differs from power supply 30' in FIG. 3*c* in having an internal potential midway between the positive potential and the negative potential, where this intermediate potential is connected to output terminal 34", which in turn is connected to the reference potential (ground 17).

Figure 4A:
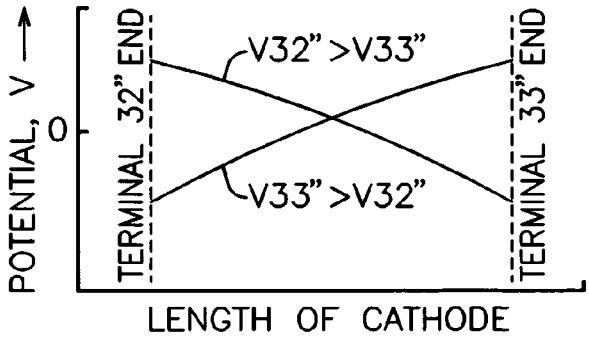
Fig. 4a (PRIOR ART)
FIG. 4*a* shows the potential distributions along the hot-filament cathode of FIG. 4.

The potential distributions along hot-filament cathode 16 using the power supply configuration shown in FIG. 4 are shown in FIG. 4*a*. The distributions in FIG. 4*a* are similar to those of FIG. 2*a* in that they are approximately symmetrical about the reference potential. This improvement is accomplished at the expense of generating two independently controlled and regulated potential differences within power supply 30" (each of magnitude V(IN)/2) instead of one controlled and regulated potential difference within power supply 30' (of magnitude V(IN)). These two potential differences can be generated with different circuits, but the circuitry will always be more complicated than for generating one potential difference. The reduction in departure from a reference potential with power supply 30" is thus accomplished at a substantial increase in parts count and cost in the part of the power supply for which the circuit is not shown.

The power-supply technologies described above can be further compared. The technology of FIG. 2 was used to make a cathode heating-current power supply for the EH1000 (the aforementioned commercial end-Hall ion source manufactured and sold by Kaufman & Robinson, Inc.) using 50-60 Hz linear/LFPC techniques. The model number of this power supply is FC900. In a 17-inch-wide module for an instrumentation rack, it has a 3 U height of 133 mm (5.25 in.) and a weight of 18 kg. Another power supply made and sold for the same purpose by Kaufman & Robinson, Inc., but using the technology of FIG. 3*c* and high-frequency switch-mode techniques is the model number FC1000. In the same 17-in width, this power supply has a 1 U height of 45 mm (1.75 in.) and a weight of only 7.3 kg. (Cabinets designed for rack-mounted installation use standard modular heights measured in "U"s where 1 U=1.75 in.)

Figure 5:
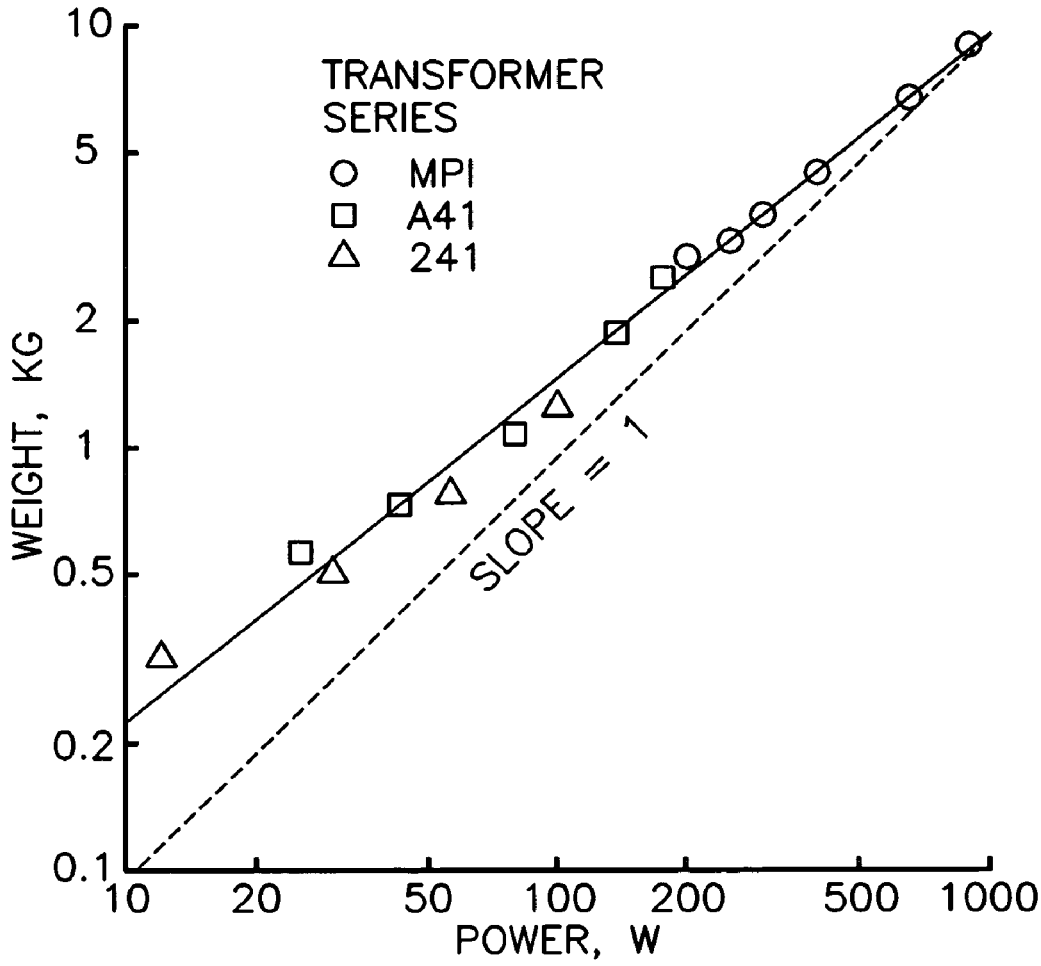
Fig. 5 (PRIOR ART)
FIG. 5 shows the typical variation of prior-art transformer weight with transformer power for a 50/60-Hz cathode-heating application such as shown in FIG. 2.

The substantial differences in size and weight of these two power supplies is due mostly to the 50-60 Hz power transformer used in the former. A plot of typical weights of transformers for powers from 12 to 900 W is shown in FIG. 5. The data for this plot were obtained from Catalog ST-5 published by Signal Transformer Co., Inwood, N.Y. in 1994. The transformers plotted were all 50-60 Hz 115/230 VAC input, 36 VAC output, and of chassis mounted configuration. The capacities of these transformers were given in VA (Volt-Amps), but for resistive hot-filament loads operated at 50-60 Hz, the VA capacity translates directly into Watts. The power transformer used in power supply Model FC900 is the largest of the MPI series (MPI-900-36), which is 102 mm high and weighs 9.0 kg. The transformer height is the reason for the use of a 3 U (133 mm high) cabinet, while the transformer weight of 9.0 kg explains most of the 10.7 kg weight difference between the two supplies. It is worth noting that the power transformer of the FC900 supply weighs more than the entire switch-mode FC1000 supply.

DESCRIPTION OF PREFERRED EMBODIMENTS

Figure 6:
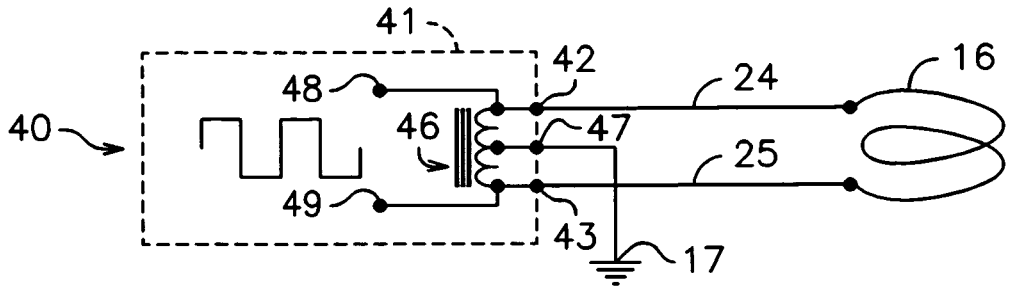
FIG. 6 shows a simplified electrical circuit diagram of a hot-filament, electron-emitting cathode together with an alternating-current power supply incorporating an embodiment of the present invention to generate the heating current for the cathode.

Referring to FIG. 6, there is shown a simplified electrical circuit diagram of hot-filament, electron-emitting cathode 16 together with alternating-current (ac) power supply 40 incorporating an embodiment of the present invention to generate a heating current for cathode 16 in which the departure of cathode potential from a reference potential (ground 17) is minimized. A differential ac voltage is supplied to terminals 48 and 49. That is, the supply waveform voltage is defined by the potential difference at terminals 48 and 49, with no limitation on the absolute voltage level at either terminal. (The source of this differential ac waveform can be described alternatively as being electrically isolated.) Terminals 48 and 49 are connected to the two ends of the single winding of autotransformer 46. Terminals 48 and 49 are also connected to two power output terminals 42 and 43 of power supply 40. These power output terminals are connected to transmission-line conductors 24 and 25, which in turn are connected to electron-emitting hot-filament cathode 16. The electrical source supplying the differential voltage waveform supplied to terminals 48 and 49 is capable of supplying an ac heating current to cathode 16 sufficient to heat that cathode to electron-emitting temperature.

Figure 6A:
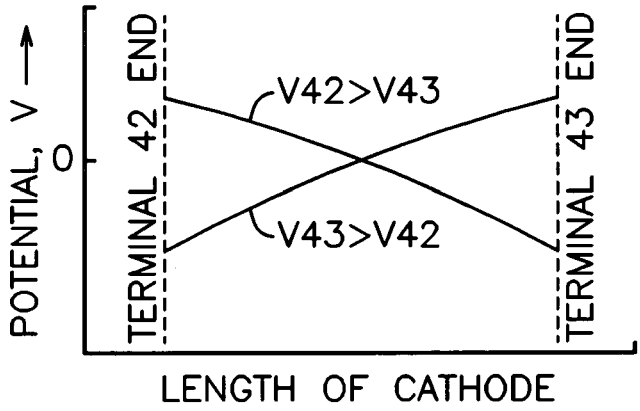
FIG. 6*a* shows the potential distributions along the hot-filament cathode of FIG. 6.

The single winding of autotransformer 46 also has a center tap, which is connected to reference output terminal 47 of power supply 40. The absolute potential level of the differential waveform that heats cathode 16 is determined by the reference potential attached to output terminal 47, which in FIG. 6 is the potential (zero) of ground 17. Terminals 48 and 49 connect across the entire autotransformer, which can be considered the primary winding of the autotransformer. The winding from one end of the autotransformer (the end connected to terminal 49, for example) to the center tap can be considered the secondary. Because the secondary has half as many turns as the primary, the ac voltage across the secondary is half the ac voltage applied to the primary. The center tap of autotransformer 46 thus provides an ac potential midway between the ac potentials at the two ends of the cathode. When the center tap is connected to the reference potential, as shown in FIG. 6, the ends of cathode 16 oscillate in a symmetrical manner about the constant reference potential, as shown in FIG. 6*a*. Although the circuitry is different, using the center tap of an autotransformer instead of the center tap of a secondary winding of a power transformer, the potential distributions in FIG. 6*a* for the circuit shown in FIG. 6 are similar to the potential distributions shown in FIG. 2*a* for the circuit shown in FIG. 2.

Figure 6B:
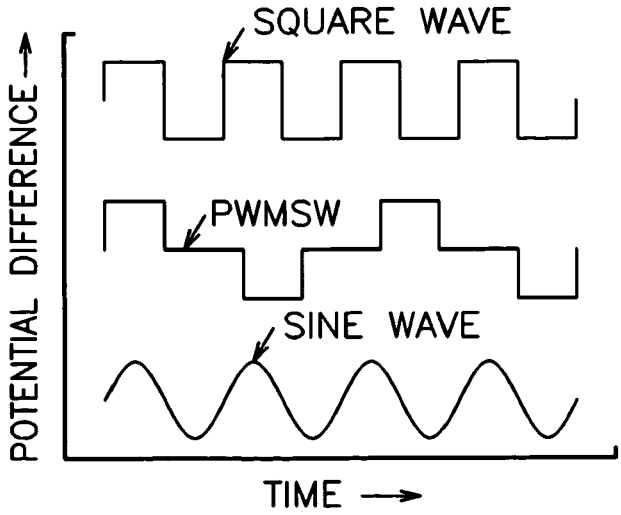
FIG. 6*b* shows different alternating-current waveforms that can be used with the embodiment of the present invention shown in FIG. 6.

The differential ac voltage waveform supplied to terminals 48 and 49 in FIG. 6 is intended to be a general one. Different ac waveforms are possible, as shown in FIG. 6*b*. There is no reference potential shown in FIG. 6*b* because a differential ac voltage is assumed to be supplied to terminals 48 and 49. A square wave can be used, as shown at the top of FIG. 6*b*, or a sine wave can be used, as shown at the bottom of FIG. 6*b*. As another example of the wide range of possible waveforms, a pulse-width modified square wave (PWMSW) is shown in the middle of FIG. 6*b*. The waveforms shown in FIG. 6*b* are all symmetrical. That is, except for sign, the shape and amplitude of the waveform is the same. Although nonsymmetrical waveforms have been used in ac power supplies, symmetrical ones are more common.

Figure 6C:
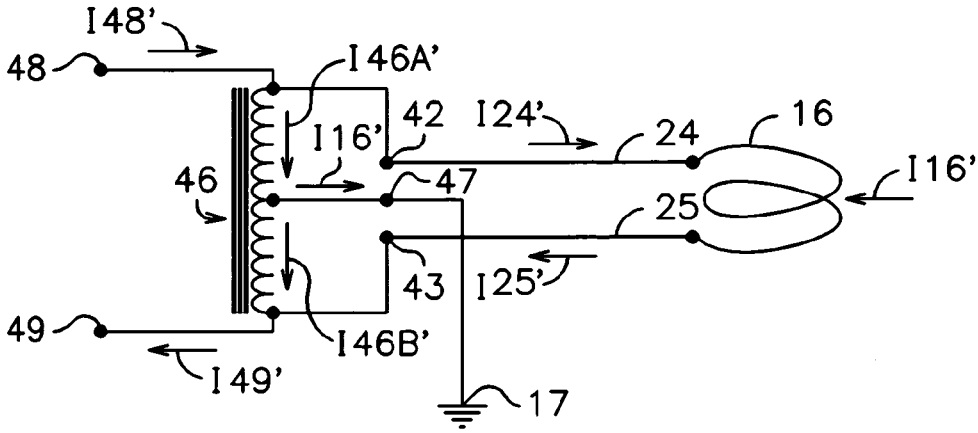
FIG. 6*c* is the simplified electrical circuit diagram of FIG. 6, showing conventional currents and their directions when conductor 24 is positive of conductor 25.

Referring to FIG. 6*c*, there is shown the circuitry of FIG. 6, with the directions of conventional (positive) currents in the different conducting paths indicated thereon. These currents are defined in a manner similar to those in FIG. 2*b*, with primed quantities denoting currents for the case where conductor 24 (and terminal 42) is positive relative to conductor 25 (and terminal 43). The double-primed quantities which would denote currents for the case where conductor 25 (and terminal 43) is positive relative to conductor 24 (and terminal 42) are not shown here in the interest of simplifying FIG. 6*c*, but double-prime quantities should be readily apparent to one skilled in the art by comparing FIGS. 2*b* and 6*c*. (I16' and I16" are dc currents and therefore have the same directions. All other currents are ac currents and will change directions between primed and double-primed currents.)

The ac input currents I48' and I49' are from a differential (electrically isolated) source and therefore must have equal magnitudes.

$$I48'=I49' \tag{9}$$

There is a small magnetizing current in a transformer primary, typical a few mAmp when the maximum current is several Amp. In autotransformer 46, this primary magnetizing current is I46M' and, $$I46M'<<I48' \text{ (or } I49'). \tag{10}$$

The ac components of currents I24' and I25' are smaller than the input currents by the magnetizing currents.

$$I24(AC)'=I48'-I46M' \tag{11}$$

$$I25(AC)'=I49'-I46M' \tag{12}$$

Emission current I16' is essentially a direct current (dc) and is therefore split equally between conductors 24 and 25. (Assuming positive and negative portions of the ac waveforms are symmetrical, except for sign, there can be no preference for the dc emission current to flow in either conductor 24 or conductor 25 in double-primed portion of the cycle when terminal 43 is positive of terminal 42.) This means that $$I24'=I24(AC)'-I16'/2, \quad (13)$$

$$I25'=I25(ac)'+I16'/2. \quad (14)$$

Using Equations (11) and (12) to substitute for I24(AC)' and I25(AC)' in Equations (13) and (14), $$I24'=I48'-I46M'-I16'/2, \quad (15)$$

$$I25'=I49'-I46M'+I16'/2. \quad (16)$$

The magnitude of current I46A' in the upper half of autotransformer 46 can be found by subtracting I24' from 148', while the magnitude of current I46B' in the lower half of autotransformer 46 can be found by subtracting I25' from I49'. (Note that the assumed directions of the currents 146A' and 146B' in FIG. 6*c* correspond to the direction of the magnetizing current I46M'.)

$$I46A'=I48'-I24'=I46M'+I16'/2 \quad (17)$$

$$I46B'=I49'-I25'=I46M'-I16'/2 \quad (18)$$

We are concerned here with sizing autotransformer 46, which is determined by maximum current conditions. For such conditions, where emission current I16' is substantial compared to heating current I24(AC)' or (I25(AC)'), it is also true that $$I46M' \ll I16'. \quad (19)$$

For Inequality (19) to be true, I46B' is negative, which means that the direction of net current I46B' is opposite to the direction shown in FIG. 6*c*. It follows that, with equal magnitude, opposite direction dc currents in the two halves of the autotransformer, there is no net dc ampere-turns saturating the magnetic core, and the important limitation on operation will be the resistive heating of the autotransformer conductor due to the dc currents carried therein.

This point should be emphasized. The conductors in output power transformer 26 must be sized for the power transmitted to hot-filament cathode 16. The conductor in autotransformer 46 must be sized for a much smaller current, half of the emission current. When using low-frequency heating currents to avoid the operating problems that result from the reactive impedances at the higher ac frequencies, the present invention avoids the weight penalty of the prior-art shown in FIG. 2. The prior art of U.S. Pat. No. 6,911,789—Geissler, et al, also avoids the weight penalty of the prior art shown in FIG. 2. But as discussed in connection with FIG. 3*c*, a reference potential can be connected to the positive terminal in the waveform generator, or the negative terminal, but not a potential midway between the two. Without an output power transformer, a potential midway between the positive and negative potentials is possible only by making such a potential available within the waveform generator, as shown in FIG. 4.

For a typical emission current of 5 A for operation with ion source EH1000, heating is caused by a 2.5 A current in the autotransformer. (The current being in opposite directions in the two halves of the autotransformer is not important. The heating depends on the square of the current and is independent of current direction.)

We can satisfy the requirement for an autotransformer by using only the 36 V secondary of one of the 60 Hz power transformers included in FIG. 5 and leaving the 115/230 V primary unconnected. To satisfy the requirement for a 25 A, 36 V heating current, we already know that a 900 Volt-Amp (900 W for a resistive load) capacity is necessary. Although the 36 V requirement remains, the current requirement set by the emission is only 2.5 A. This means that a 2.5×36=90 Volt-Amp capacity will be required. This capacity is available with a transformer from the 241 series (Signal Transformer DP-241-8-36) with a 100 Volt-Amp capacity and a weight of only 1.25 kg.

Using similar heating-current requirements, the use of an autotransformer to establish the equivalent connection for a reference potential (FIG. 6) thus saves almost 8 kg when compared to a power transformer with a center tap in the secondary (FIG. 2). It should be apparent that cost increases approximately with weight, so that the weight saving also implies a substantial cost saving. It should also be apparent that the unused primary in the 241-series transformer could be omitted, resulting in a further weight saving. If the purchase of a large enough quantity were made, the further weight saving could be translated into a further cost saving.

It should be pointed out that the use of 36 V for hot-filament electron-emitting cathode 16 in FIG. 6 is intended to be illustrative. It is true that many hot-filament cathodes operate near this voltage, but the use of this invention is not restricted to any particular voltage range. It should also be evident to one skilled in the art that hot-filament, electron-emitting filaments operate over a range of voltage as they age and erode away. This means that one selects a transformer, autotransformer, etc. to have a voltage capability at least as high as the highest voltage that is expected. On the other hand, one should not choose a voltage capability greatly above what is needed, or a penalty in weight, power losses, and cost will be paid for the unnecessary voltage capability.

ALTERNATE EMBODIMENTS

Autotransformer 46 in FIG. 6 is described as having a single winding with a center tap. In the selection of Signal Transformer DP-241-8-36 to perform the function of an autotransformer, it is recognized that an unused (open circuit) primary has no effect on the use of the secondary as an autotransformer. There could have been two 18 V secondaries instead of one 38 V secondary with a center tap, as is the case for both the MP1 and A41 series of transformers shown in FIG. 5. The two 18 V secondaries could then have been connected in series so as to perform the function of a single winding with a center tap, with the junction of the two windings serving as the center tap.

Although it is a matter of terminology rather than configuration, it should also be noted that autotransformer 46 in FIG. 6 could also be described as an inductor with a center tap, with the magnitude of the inductance large enough that the ac current through it is small compared to both the ac current transmitted to the electron-emitting hot-filament cathode and the dc electron emission from that filament. With equal magnitude, opposite direction dc currents in the two halves of the inductor, there is again no net dc ampere-turns saturating the magnetic core, and the important limitation on operation will be the resistive heating of the autotransformer conductor due to the dc currents carried therein. In short, considering autotransformer 46 to be an inductor rather than a autotransformer changes only the terminology, not the function of this component.

SPECIFIC EXAMPLE

The preceding example was carried out with 50-60 Hz sine waves for both a cathode supply with an output power transformer (FIG. 2) and a cathode supply with an autotransformer at the output. The approach used in this example was selected to assure like-to-like comparisons: same frequency, same waveform, same manufacturer, even similar transformer designs.

Figure 7:
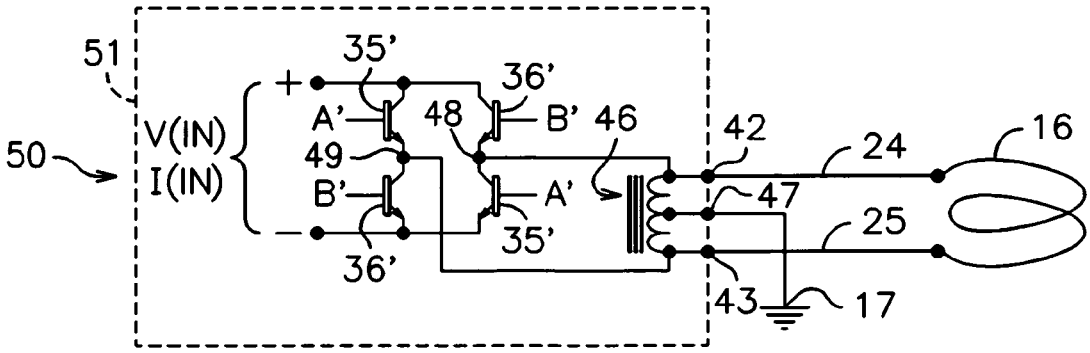
FIG. 7 shows a simplified electrical circuit diagram of a hot-filament, electron-emitting cathode together with another embodiment of the present invention using the alternating current generating circuit shown in FIG. 3*c*.

In practice, a square wave is more likely to be used with an autotransformer when the basic waveform is supplied with switch-mode technology. Referring to FIG. 7 there is shown a simplified electrical circuit diagram of a hot-filament, electron-emitting cathode together with power supply 50 in enclosure 51 that incorporates another embodiment of the present invention using the alternating current generating circuit shown in FIG. 3*c*. Although pulse-width or frequency modulation can be used to control the heating power for cathode 16, it is also quite convenient to use a square wave as the waveform and vary the amplitude of the square wave to control the heating power. The latter approach was used in the aforementioned power supply FC1000. An FC1000 power supply was modified to use an autotransformer as shown in FIG. 7. The square-wave frequency was approximately 70 Hz. A custom autotransformer was designed for the FC1000 to supply an emission of 1 A for the neutralizer of a gridded ion source. The weight of this autotransformer is 0.35 kg. The shape is a toroid with a height (normal to the toroid axis of symmetry) of 30 mm. This small a height can easily fit into the 1 U cabinet height of the FC1000.

Inasmuch as the frequency does not depart drastically from 50-60 Hz and the voltages are nearly the same (40 vs. 36), the custom autotransformer can be compared to a transformer plotted in FIG. 5. Using half of the emission current (0.5 Amp) and the maximum voltage of 40 V, a 20 Volt-Amp capacity will be required. The closest power transformer in FIG. 5 is one from the A41 series (Signal Transformer A41-25-36) with a 25 Volt-Amp capacity, which weighs 0.57 kg. Probably the biggest factor in the low weight of the custom autotransformer is the absence of a 115/230 V primary. In either case, the custom autotransformer at 0.35 kg or the approximate choice from FIG. 5 at 0.57 kg, the weight is drastically reduced from the 9 kg of a power transformer carrying the full heating power for the cathode.

While particular embodiments of the present invention have been shown and described, and various alternatives have been suggested, it will be obvious to those of ordinary skill in the art that changes and modifications may be made without departing from the invention in its broadest aspects. Therefore, the aim in the appended claims is to cover all such changes and modifications as fall within the true spirit and scope of that which is patentable.

We claim:

1. A power-supply apparatus for generating an alternating heating current for an electron-emitting hot-filament cathode comprising:

an internal differential alternating-current (ac) source of electrical power, wherein said source has sufficient current and voltage capacity to heat an electron-emitting cathode to electron-emitting temperature;

an autotransformer comprising a single winding having two ends and a center tap;

two power output terminals;

one reference output terminal connected to a reference potential;

wherein said internal differential ac source of electrical power is connected to said two ends of said autotransformer winding, with said two ends connected respectively to the said two power output terminals; and wherein said center tap is connected to said reference output terminal.

2. A power-supply apparatus as defined in claim 1 wherein said alternating heating current has a period for a cycle, wherein each period has a portion thereof during which there is no heating current generated for said cathode.

3. A power-supply apparatus as defined in claim 1 wherein said internal differential ac source of electrical power uses switch-mode techniques.

4. A power-supply apparatus as defined in claim 1 wherein said internal differential ac source of electrical power has a frequency between ten Hz and 10 kHz.

5. A method for making a power-supply for generating an alternating heating current for an electron-emitting hot-filament cathode comprising the steps of:

providing an internal differential alternating-current (ac) source of electrical power, wherein said source has sufficient current and voltage capacity to heat an electron-emitting cathode to electron-emitting temperature;

providing an autotransformer having single winding, which has two ends and a center tap;

connecting said internal source of electrical power to said two ends of said single winding of said autotransformer;

providing two power output terminals;

connecting said two ends of said single winding to the respective said two power output terminals;

providing one reference output terminal; and connecting said center tap of said winding to said reference output terminal.

6. A method for making a power supply as defined in claim 5 wherein said alternating heating current has a period for a cycle, wherein each period has a portion thereof during which there is no heating current generated for said cathode.

7. A method for making a power supply as defined in claim 5 wherein said internal differential ac source of electrical power uses switch-mode techniques.

8. A method for making a power supply as defined in claim 5 wherein said internal differential ac source of electrical power has a frequency between ten Hz and 10 kHz.

* * * * *